US006354800B1

(12) United States Patent
Hays

(10) Patent No.: US 6,354,800 B1
(45) Date of Patent: Mar. 12, 2002

(54) DUAL PRESSURE EULER TURBINE

(76) Inventor: Lance G. Hays, 2737 Ridgepine, La Crescenta, CA (US) 91294

( * ) Notice: Subject to any disclaimer, the term of this patent is extended or adjusted under 35 U.S.C. 154(b) by 0 days.

(21) Appl. No.: 09/539,342

(22) Filed: Mar. 31, 2000

(51) Int. Cl.[7] ..... F01D 1/02
(52) U.S. Cl. ..... 415/202
(58) Field of Search ..... 415/202, 60, 62, 415/63, 64, 68, 69, 83, 84, 80, 81, 199.2, 199.3

(56) References Cited

U.S. PATENT DOCUMENTS 3,758,223 A * 9/1973 Eskeli ..... 415/1
4,430,042 A * 2/1984 House ..... 415/1
4,441,322 A * 4/1984 Ritzi ..... 60/649
5,413,457 A * 5/1995 Tuckey ..... 415/55.6

* cited by examiner

*Primary Examiner*—Edward K. Look
*Assistant Examiner*—James M McAleenan
(74) *Attorney, Agent, or Firm*—William W. Haefliger

(57) ABSTRACT

A turbine including a rotor on a shaft and comprising in combination stationary nozzles discharging fluid, thereby producing impulse forces on a rotor; internal passages in the rotor producing compression of the fluid; nozzles on the rotor discharging fluid to a pressure lower than the discharge pressure of the stationary nozzles, thereby producing reaction forces on the rotor whereby shaft power is produced.

28 Claims, 8 Drawing Sheets

FIG. 2.

ROTOR VELOCITY $U_2$ →

FLUID RELATIVE VELOCITY $W_2$ ←

FLUID ABSOLUTE VELOCITY $C_2$ →

FIG. 4a.

ROTOR VELOCITY $U'_2$ →

FLUID RELATIVE VELOCITY $W'_2$ ←

FLUID ABSOLUTE VELOCITY $C'_2$.

FIG. 4b.

ROTOR VELOCITY $U'_2$ →

FLUID RELATIVE VELOCITY $W'_2$ ←

FLUID ABSOLUTE VELOCITY $C'_2$ ←

FIG. 4.

EFFICIENCY VS. INTERMEDIATE PRESSURE
FOR LIQUID DUAL PRESSURE EULER TURBINE

EFFICIENCY
1
0.9
0.8
0.7
0.6
0.5
0.4
0.3
0.2
0.1
0
A
B
C
0
10
20
30
40
50
60
70
80
90
100
INTERMEDIATE PRESSURE, $P_I$ PSIA

EFFICIENCY OF DUAL PRESSURE EULER TURBINE
VERSUS INTERMEDIATE PRESSURE FOR AIR EXPANSION
FROM 35 TO 14.7 PSIA

DUAL PRESSURE EULER TURBINE

BACKGROUND OF THE INVENTION

This invention relates generally to turbines, and more particularly to hybrid turbines employing both impulse and reaction stages.

The single pressure Euler turbine was invented in 1754 by Euler. The original application for the turbine was as a water wheel. The turbine converts incoming kinetic energy in a fluid stream to shaft power through an internal compression and re-acceleration process.

Since 1754, other turbines have been invented and improved in many ways, all in an effort to improve efficiency. There is need to provide turbines having yet higher efficiencies with low cost, and for this purpose, hybrid turbines have been developed, employing both impulse and reaction stages. However, there remains need to develop hybrid turbines having yet higher efficiencies and lower costs.

SUMMARY OF THE INVENTION

It is a major object of the invention to provide an improved hybrid turbine having very high efficiency and/or low cost resulting from a simple structure.

It is another object of the invention to provide a hybrid turbine that achieves very high efficiency, by utilization and development of a fluid compression stage between impulse and reaction turbine stages.

Another object is to provide a turbine including a rotor on a shaft, and having:

a) stationary nozzles discharging fluid, thereby producing impulse forces on the rotor, b) internal passages in the rotor producing compression of the fluid, c) nozzles on the rotor discharging fluid to a pressure lower than the discharge pressure of the stationary nozzles, thereby producing reaction forces on the rotor, d) whereby shaft power is produced. As will be seen, the turbine may utilize liquid or gas as a working fluid.

A further object is to provide a seal, or seals, or sealing means, located to enable the discharge pressure from the rotating nozzles to be lower than the discharge pressure from the stationary nozzles.

Yet another object is to provide radial vanes to cause fluid to rotate at the same velocity as the rotor; and in addition, all flow is preferably in generally radial directions, whereby there is substantially no resultant axial force on the rotor.

Another object is to provide a smooth, cylindrical plate to receive the flow from the stationary nozzles, shielding the rotor vanes from periodic forces.

An additional object is to provide a fluid driven turbine comprising, in combination:

a) first rotating fluid driven vanes defining an impulse turbine stage, b) second rotating fluid driven vanes defining a reaction turbine stage, c) and a fluid compression zone in the fluid path between the first and second vanes, and defining a fluid compression stage. As will be seen, the first vanes typically extend in a first ring, the second vanes extend in a second ring, the rings being coaxial, and the fluid compression zone is annular and located in the fluid path between the rings.

Another object is to provide a rotating surface toward which fluid travels and produces fluid compression. That surface may extend annularly and in coaxial relation with the vanes. In this regard, the first ring of vanes typically is stationary, and the second ring of vanes is rotating, there being structure carrying the second ring of vanes for rotation.

These and other objects and advantages of the invention, as well as the details of an illustrative embodiment, will be more fully understood from the following specification and drawings, in which:

DRAWING DESCRIPTION

FIG. 1 is an elevation taken through a turbine;

FIG. 1*a* is a section taken on lines A—A of FIG. 1;

FIG. 2 is a vector diagram;

Figure 3A:
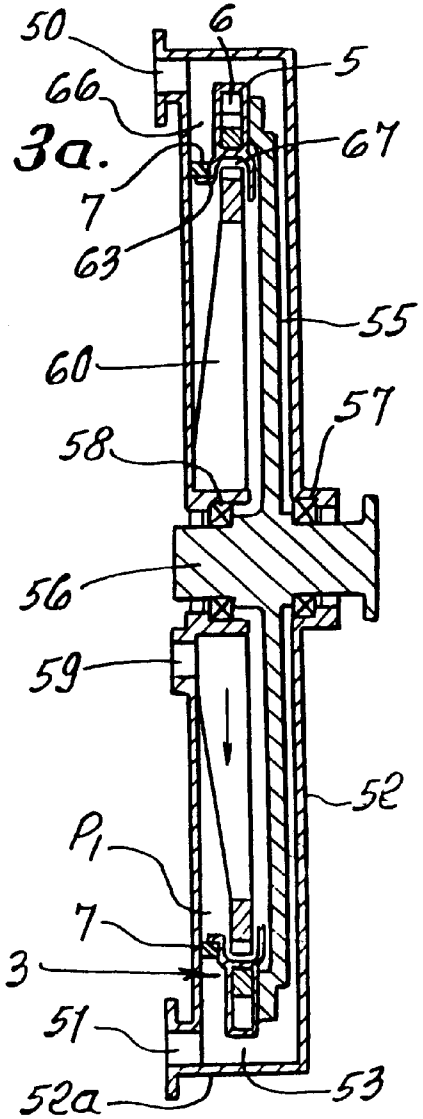
FIG. 3 is an elevation taken through a dual pressure Euler turbine, embodying the present invention.
Figure 3:
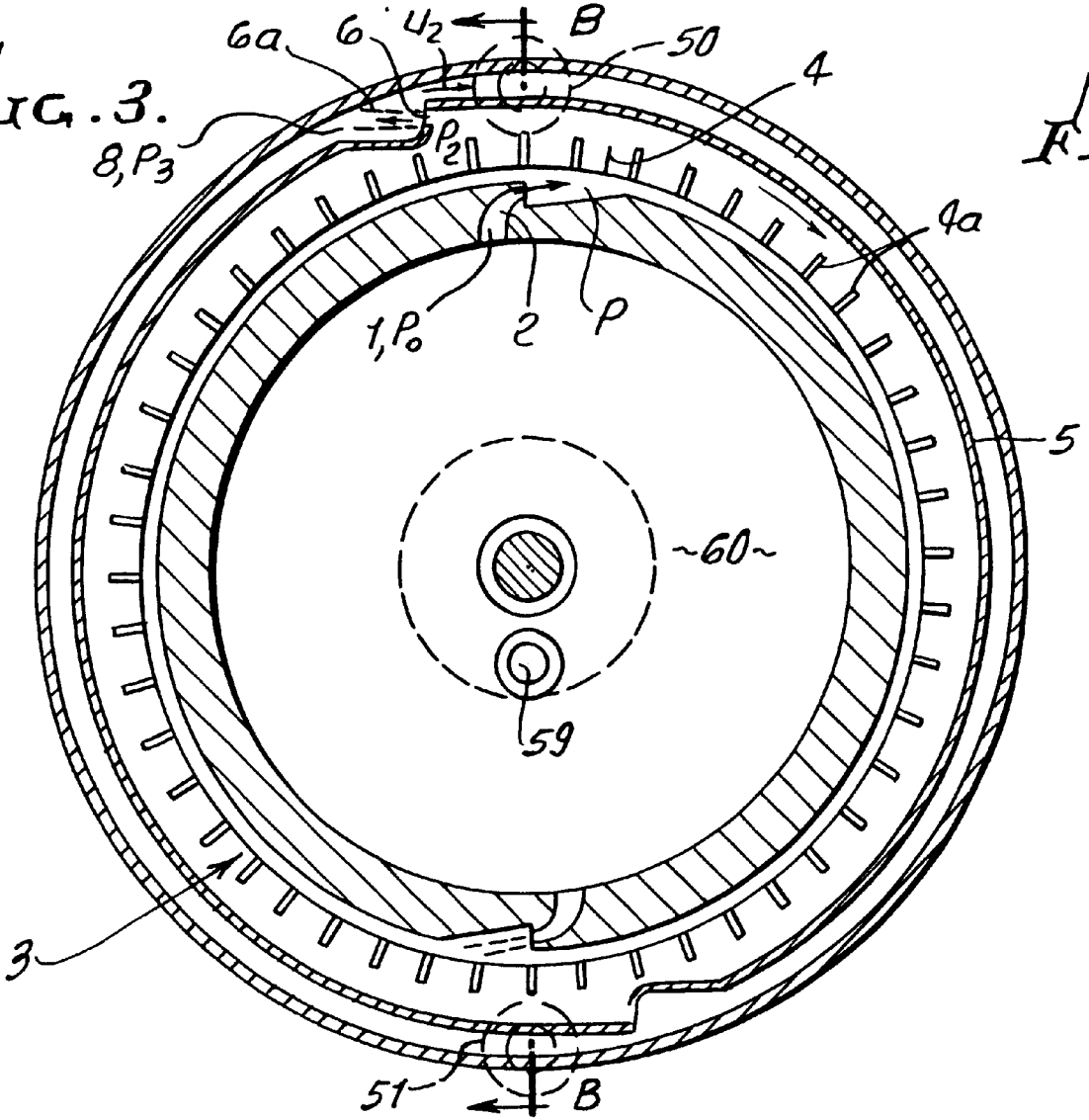
Figure 7:
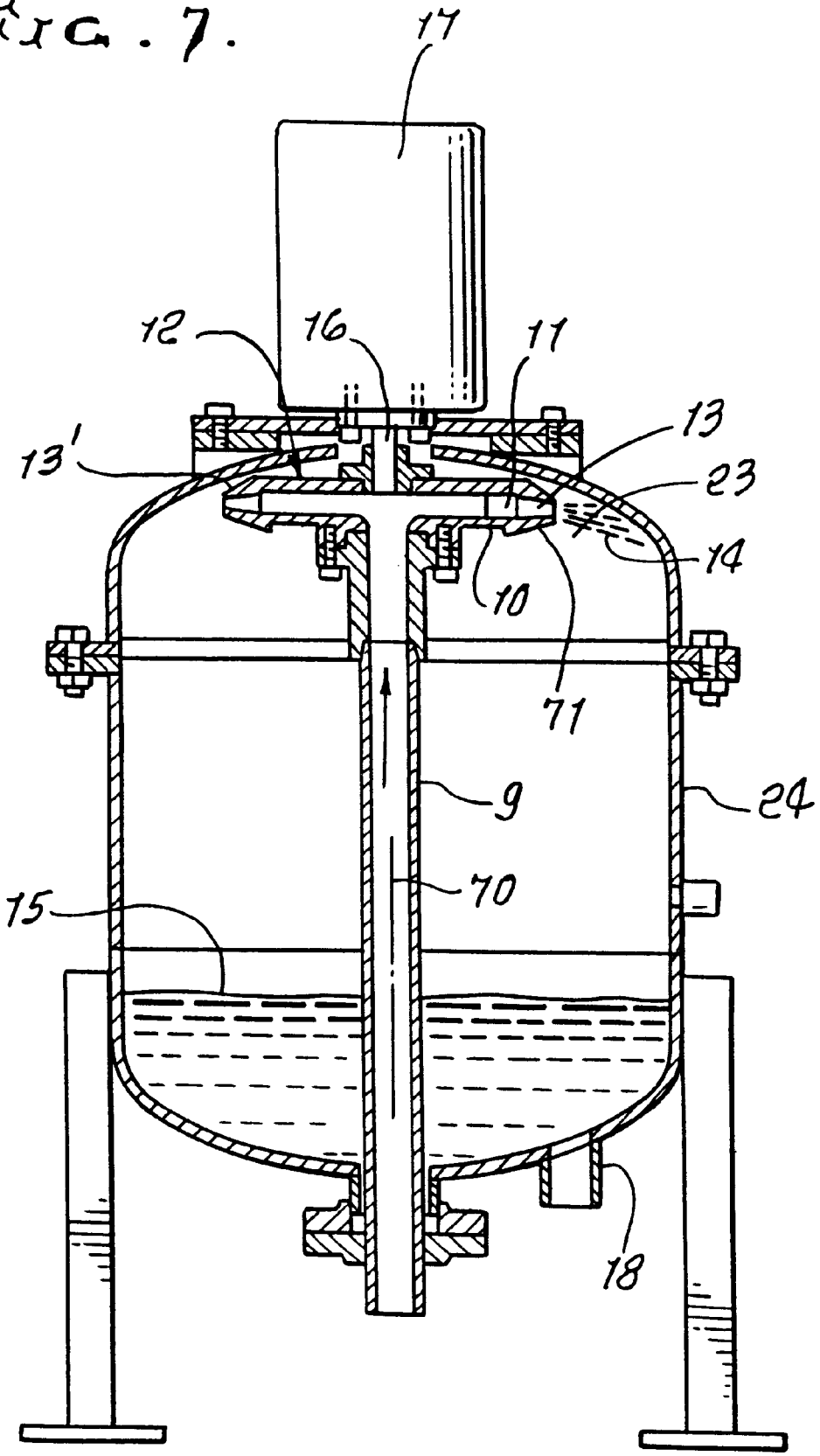
Figure 8:
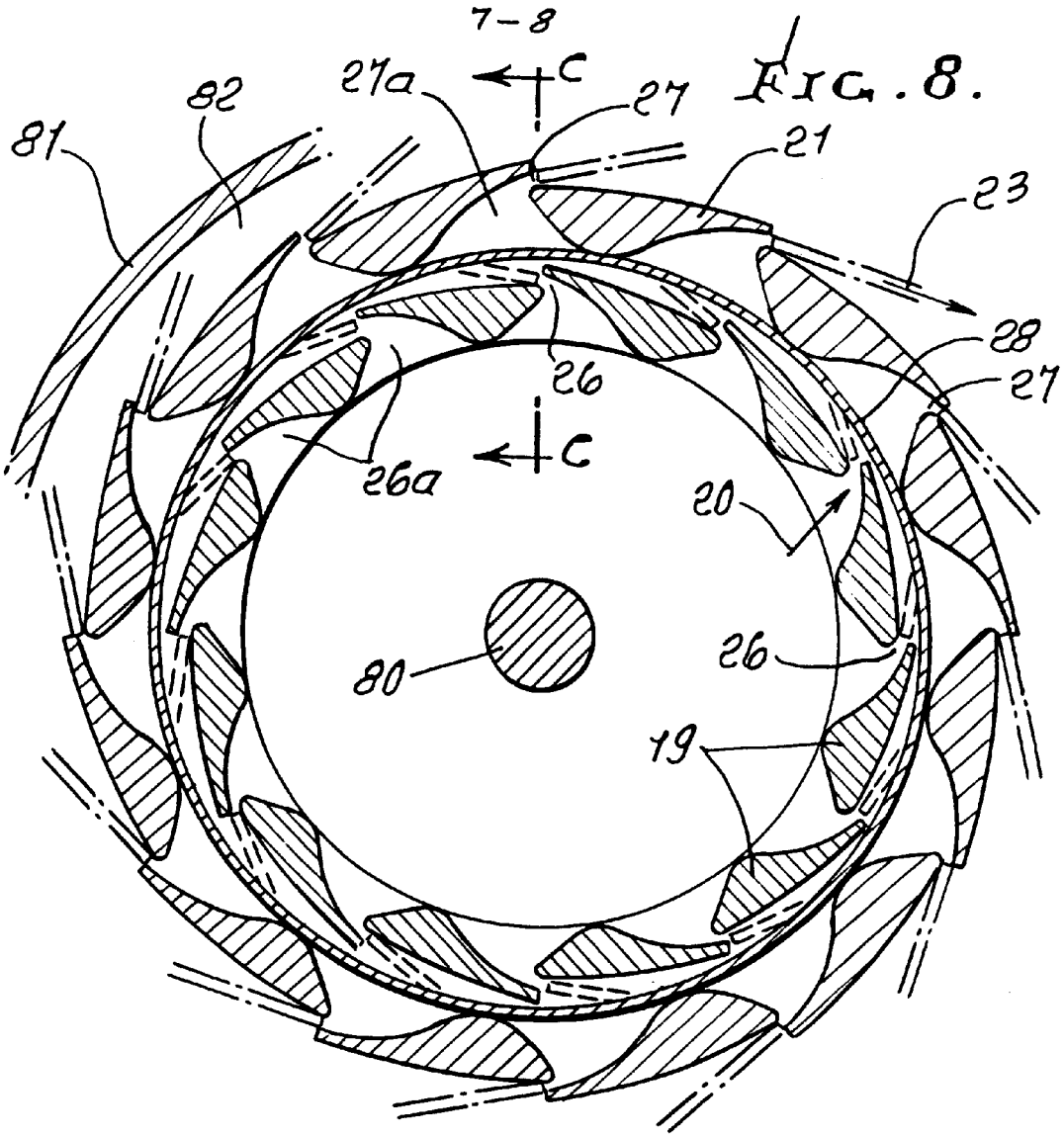
Figure 8A:
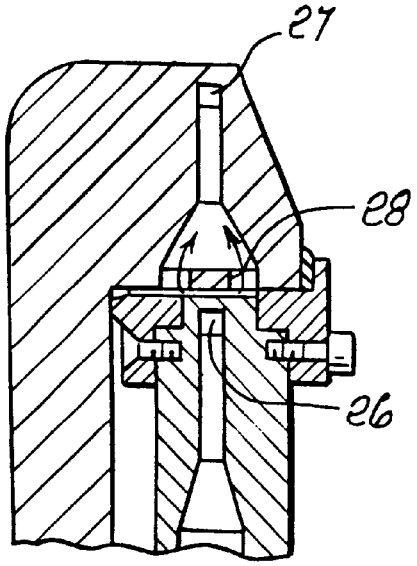

FIG. 3*a* is a section taken on lines B—B of FIG. 3;

FIG. 4 is a vector diagram;

FIG. 5 is a graph;

FIG. 6 is a graph;

FIG. 7 is a section taken through a dual pressure Euler turbine rotor and in a plane normal to the rotor axis, and extending radially;

FIG. 8 is a section taken through the turbine of FIG. 3, and normal to the rotor axis, to show vane configurations;

FIG. 8*a* is a section taken on lines C—C in FIG. 8; and

Figure 9:
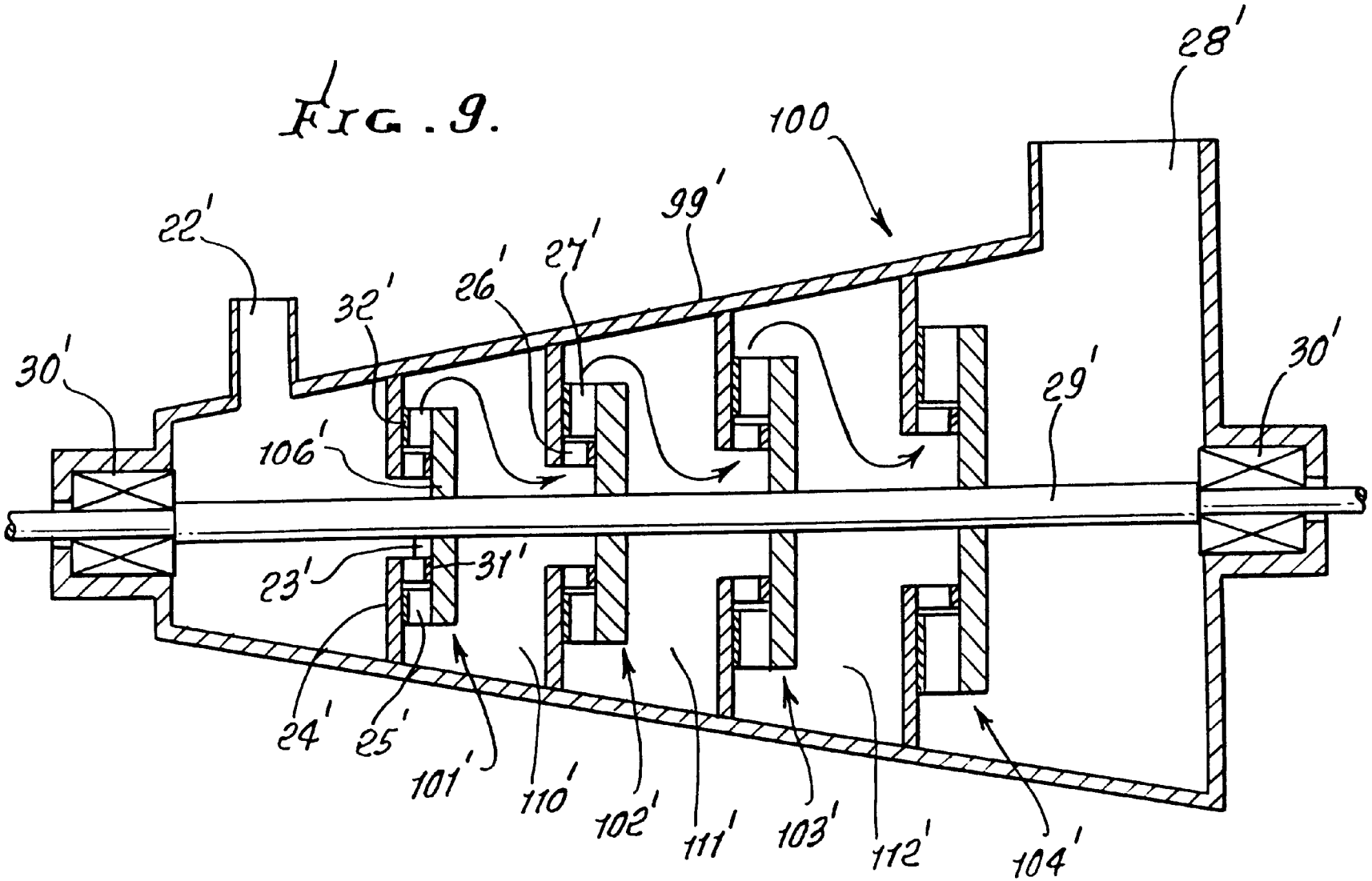

FIG. 9 is an axial section schematically showing a multistage, dual pressure, Euler type turbine.

DETAILED DESCRIPTION

Figure 1A:
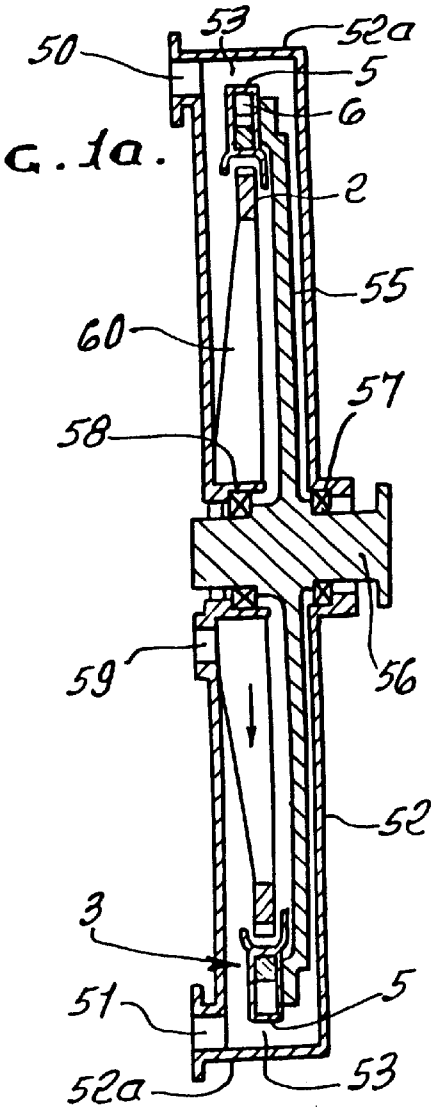
Figure 1:
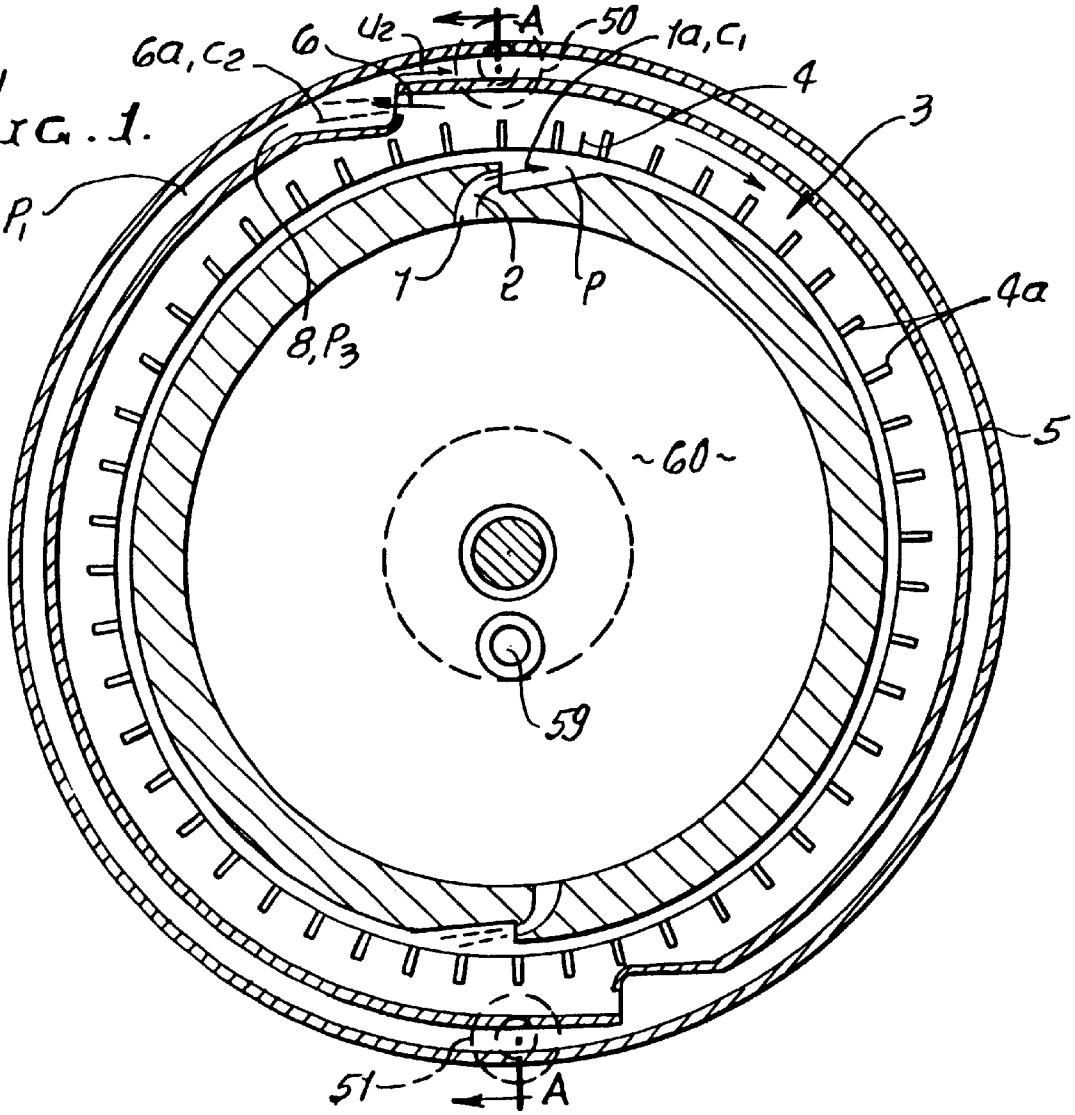

FIG. 1 is an example of the single pressure turbine. Fluid at 1 is accelerated in a nozzle 2, forming an exit stream 1*a* having kinetic energy and exit velocity $C_1$. The stream has its tangential component either accelerated to, or decelerated to, the velocity of the rotating turbine ring or rotor structure 3. The rotating liquid at 4 flows radially outward between rotating vanes 4*a* at a velocity that is low relative to the incoming tangential velocity $C_1$. The centrifugal acceleration field created by the rotating turbine structure produces a body force on the fluid, increasing its pressure. At the rotating wall or periphery 5 of the rotor structure 3, the increased fluid pressure is utilized to accelerate the fluid through a nozzle 6 (directed angularly as shown) whereby the fluid acquires a velocity relative to the rotating structure in the direction counter to the rotation of the turbine structure. The fluid leaving the structure at 6*a* has an absolute velocity $C_2$ below the velocity $U_2$ of the tip of the rotating rotor. This is illustrated in the velocity vector diagram of FIG. 2. The energy transfer into the rotor is determined from Euler's equation:

$$H=C_1U_1-C_2U_2$$

Where:

H=the head transferred to the rotor $C_1$=the tangential component of velocity of the fluid leaving the first nozzle $U_1$=the tangential component of the rotor speed at the location of the first nozzle $C_2$=the absolute velocity of the fluid leaving the rotor at the exit of the second nozzle $U_2$=the velocity of the rotating structure at the location of the second nozzle For a liquid, the pressure rise is given by:

$$p_2-p_1=\rho\omega^2(r_2^2-r_1^2)/2\ g$$

Where:

$p_2$=the pressure at the inlet of the rotating (second) nozzle $p_1$=the pressure at the exit of the stationary (first) nozzle $\rho$=fluid density $\omega$=rotational speed r=radius to stations 2 (at 6) and 1 (at 1) respectively g=gravitational constant If the fluid is expanded through the second nozzle or nozzles, the relative velocity (see FIG. 2) produced is:

$$W_2=\eta_{v2}[2g(p_2-p_1)/\rho]^{1/2}$$

Where:

$\eta_{v2}$=velocity coefficient of second nozzles. The efficiency of power transfer is given by:

$$\eta_t=[C_1U_1-(U_2-W_2)U_2]/C_1^2/2$$

Fluid outlets 50 and 51 are provided from casing 52, to discharge fluid from annular zone 53, between rotary wall 5 and fixed casing wall 52*a*.

Rotor 3 is connected at 55 to a shaft 56, carried by bearings 57 and 58, to drive the shaft. A fluid inlet 59 is provided to zone 60 delivery fluid to nozzles 2.

The efficiency of the Euler turbine is limited by the extent of the centrifugal pressure rise and the resulting relative velocity $W_2$ which is always less than the rotor tip speed $U_2$. See FIG. 2.

An unexpected method to increase the relative velocity $W_2$, thereby increasing the efficiency of the Euler turbine, is to provide two pressure stages in the expansion. In doing so the single rotor machine is converted to a two-stage turbine, and becomes a combined impulse and reaction turbine with internal compression.

FIG. 3 illustrates a dual pressure Euler turbine. The fluid in the first nozzle 2 is expanded from the initial pressure $p_0$ to a pressure of $p_1$. Once again the fluid becomes locked into the moving rotor structure at the inner radius $r_1$. Fluid flows radially outward at 4 while being locked into the rotor structure. A seal 7 is provided between casing and rotor walls 62 and 63 such that the pressure of the surrounding fluid at 66 can be maintained at a value $p_3$ which is lower than the pressure at 67 into which the first nozzle 2 discharges. The fluid is reaccelerated in the second nozzle 6 at the tip of the rotor 3; however, the pressure difference $p_2-p_3$ is no longer limited by the centrifugal pressure rise. Instead, the pressure difference is the sum of the centrifugally induced pressure rise, plus the pressure difference between the pressure at the exit of the first nozzle and the ambient pressure $p_3$ in zone 8. The relative velocity is then:

$$W_2'=\eta_{v2}[2g(p_2-p_1+p_1-p_3)/\rho]^{1/2}$$

This equation shows that the relative velocity can be increased to as high a value as wanted by decreasing $p_3$. In the above, $W_2'$ equals the relative fluid velocity leaving the rotor. See FIG. 3.

FIG. 4 shows two velocity diagrams 4(*a*) and 4(*b*) for the dual pressure Euler turbine. For the first velocity diagram, the ambient pressure of the fluid is lowered just enough that the relative velocity $W_2'$ is equal to rotor velocity $U_2'$. Therefore the absolute velocity $C_2'$ is equal to zero. In this case, the head produced is equal to:

$$H=U_1'C_1'$$

In this regard, $U_1'$, $C_1'$, $U_2'$ and $C_2'$ are values corresponding to $U_1$, $C_1$, $U_2$ and $C_2$ as defined above. The head for the dual pressure Euler turbine is:

$$H'=U_1'C_1'-U_2'C_2'$$

In the second diagram, the pressure has been lowered such that the absolute leaving velocity $C_2'$ of the fluid is in the opposite direction from rotor speed. In this case, the power transferred into the rotor is:

$$H=U_1'C_1'+U_2'C_2'$$

The added work produced by the expansion of the fluid occurs at a high tip speed and hence, the added work is very efficient.

Figure 5:
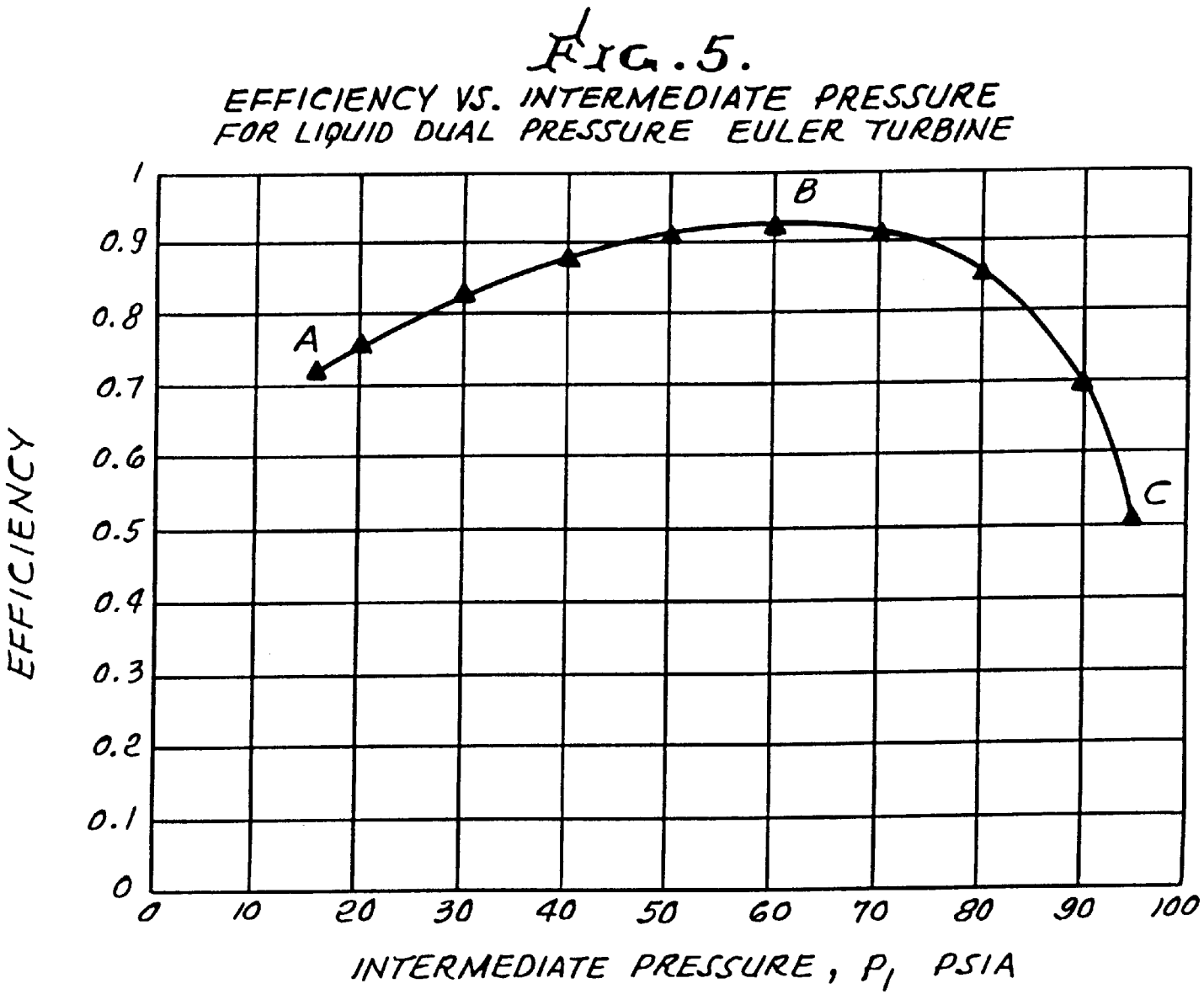

FIG. 5 shows the efficiency as a function of the intermediate expansion pressure $P_1$ for a liquid dual pressure Euler turbine. In the limiting case of the single pressure Euler turbine the efficiency is 0.72, at point A. As the intermediate expansion pressure is increased, the efficiency reaches a peak of 0.92 at B at a pressure of 60 psi. At the other extreme where the intermediate expansion pressure is equal to the inlet pressure, the dual pressure reaction turbine assumes the limit of a Hero turbine and the efficiency is only 0.5, at point C.

When the fluid is compressible, rotation of fluid in the high centrifugal acceleration field also produces a pressure rise. In this case, the fluid has a lower density and the pressure rise is lower than that for a liquid. However, due to the lower density, the lower pressure rise produces similar relative velocities.

Figure 6:
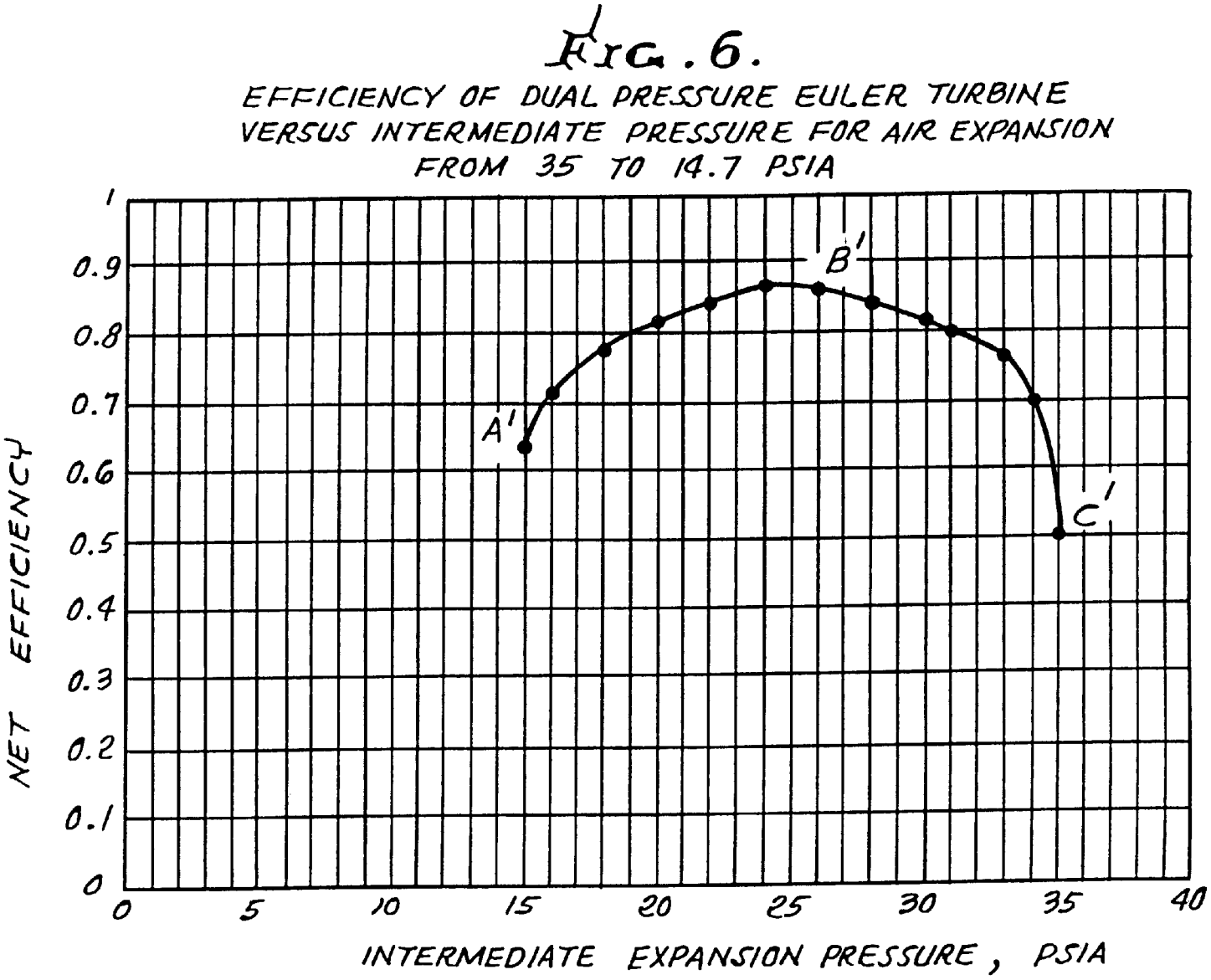

FIG. 6 is a plot of efficiency versus intermediate expansion pressure for a dual pressure Euler turbine operating with air. In this case, the efficiency is 0.63 at point A' at the limit where the intermediate pressure is equal to the ambient pressure of 14.7 psia. As the intermediate pressure is increased, the efficiency reaches a maximum of 0.87 at point B' an intermediate pressure of 26 psia. In the limit, where the intermediate pressure is equal to the inlet pressure of 35 psia, the dual pressure Euler turbine becomes a Hero turbine and the efficiency is only 0.50, at C'.

A dual pressure Euler turbine designed for operation with either liquid or gas is shown in FIG. 7. Fluid flows to the turbine through an inlet pipe 9. The fluid enters the first nozzle structure 10 and flows radially outward relative to axis 70. The fluid is expanded in the first nozzles 11 which are stationary. The accelerated fluid enters the rotating rotor structure 12, and flows radially outward through vanes 71 in the rotating structure. The pressure increases in the rotating rotor passage 13. The fluid is accelerated by the second nozzle structure 13', which is rotating as a part of the rotor structure. The fluid at 14 is discharged from the rotor to an ambient pressure in zone 23, and which is lower than the pressure at the exit of the first nozzle structure. If the fluid is a liquid, it falls to the bottom of containment vessel 24, forming a liquid level at 15. The liquid subsequently flows from the vessel through a pipe 18. If the fluid is a gas it leaves the vessel directly through the pipe 18, with no level being formed.

The power generated in the rotor 12 is transmitted through a shaft 16 to drive a generator 17.

FIG. 8 is a cross section through the first nozzle structure and rotor. The first and stationary nozzle structure is formed by a number of vanes 19 which are curved to accelerate the fluid 20, and discharge it at an angle about 10° to the tangent in vanes in this example. Vanes 19 form a first ring. The fluid from the first nozzle structure 26 enters the rotating rotor structure which has a cylindrical plate 28 with an inner surface or bore which receives the flow from the nozzles to eliminate periodic forces on the vanes, and vanes 21, in a second ring, and which guide the flow radially outward and then from nozzles 27 inclined at an angle in the reverse direction from the direction of inclination of the first nozzles. In this case the angle of inclination is also about 10° from the tangent. The accelerated flow 23 is discharged from the rotor to a pressure which is lower than the pressure at the exit of the first nozzle structure. A shaft 80 carries vanes 21. A casing wall is seen at 81. Spent fluid discharges from zone or space 82. The arrows in FIG. 8*a* show flow from the inner surface of plate 28, around the plate, and toward nozzles 27.

Note that nozzles 27 are directed oppositely in a rotary sense from nozzles 26. Entrances 26*a* converge or taper generally radially toward 26, and entrances 27*a* converge or taper generally radially toward 27.

Several nozzle rotor combinations of the above described type can be arranged in series with the rotors on a common shaft to make a multistage turbine 100. FIG. 9 shows four dpE turbines 101'–104' on a common shaft 29'. Fluid enters the housing 99' of the turbine 100 at 22'. It flows to the first stationary nozzle structure 23', which is supported by a stationary member 24'.

The fluid is accelerated in the stationary nozzle structure and flows through the rotating nozzle structure 25' generating power. The inlet pressure is sealed from the first expansion pressure by a seal 31' between 23' and a rotor 106' and the first expansion pressure is sealed from the second expansion pressure by a second seal 32' between 25' and member 24'.

The fluid leaves the first rotating nozzle structure 25' and enters the second, i.e. next in sequence, stationary nozzle structure 26', and flows through the second rotating nozzle structure 27' generating additional power. The Edp structure 102' and succeeding ones at 103' and 104' all have seals as described for the first Edp stage.

The fluid continues to flow through such additional dpE structures, generating additional power, until it leaves the turbine at 28'. The power from all stages drives the shaft 29', which has seals and bearings 30' to retain the fluid within 99'.

It will further be noted that a series sequence of turbines are provided, the rotors of which which are operatively connected to said shaft, said turbines positioned to successively pass said fluid, via the turbine stationary and rotating nozzles. Also, each turbine includes a seal or seals located to enable the discharge pressure from the rotating nozzles to be lower than the discharge pressure from the stationary nozzles. Thus, successive turbines define, with associated casing structure, sealed compartments, as at 110' , 111', and 112' which are fluid passing compartments.

A dual pressure Euler turbine provides several advances relative to conventional single phase rotating machinery, which are listed as follows:

1. Use of low radial velocity and nozzles for expansions instead of the use of high velocities and a multiplicity of blades means that high efficiencies can be realized in the high pressure-low flow regime.
2. The dual pressure Euler turbine provides two stages of expansion with a single rotor instead of the usual one stage with one rotor. This enables a greater head difference to be used efficiently for the turbine, compared to conventional turbo-machinery.
3. The dual pressure Euler turbine is a pure generally radial flow machine. There is no flow-induced thrust in the axial direction. This reduces the loss and unreliability associated with thrust bearings, which are required to support the axial forces resulting in conventional turbo-machinery from axial impulse forces, or from axial forces resulting from reaction.
4. Flow in the radial outward direction means any liquids produced during the expansion or any solids in the flow, will be ejected, without causing erosion of the first nozzle.

The dual pressure Euler turbine is a distinctly new type of turbine. Providing an intermediate expansion pressure results in a turbine having impulse forces and reaction forces with internal compression, for increased efficiency.

In the above, the seal is one form of structure for isolating the second pressure or pressures from the first pressure or pressures, and is preferred.

I claim:

1. A turbine including a rotor on a shaft and having, in combination:

a) stationary nozzles discharging fluid, at a first pressure or pressures, thereby producing impulse forces on said rotor, b) internal passages in the rotor producing compression of the fluid, c) rotating nozzles on the rotor discharging fluid at a second pressure or pressures lower than the first pressure or pressures at the discharge of the stationary nozzles, thereby producing reaction forces on the rotor, the turbine having structure isolating said second pressure or pressures are isolated from said first pressure or pressures, d) whereby shaft power is produced.

2. The combination of claim 1 wherein the turbine utilizes liquid as a working fluid.

3. The combination of claim 1, wherein the turbine uses a gaseous substance as a working fluid.

4. A turbine including a rotor on a shaft and having, in combination:

a) stationary nozzles discharging fluid, thereby producing impulse forces on said rotor, b) internal passages in the rotor producing compression of the fluid, c) rotating nozzles on the rotor discharging fluid to a pressure lower than the discharge pressure of the stationary nozzles, thereby producing reaction forces on the rotor, d) whereby shaft power is produced, e) and including a seal or seals located to enable the discharge pressure from the rotating nozzles to be lower than the discharge pressure from the stationary nozzles.

5. The combination of claim 1 wherein said nozzles have circular cross sections.

6. The combination of claim 1 wherein said nozzles are defined by two-dimensional vanes.

7. The combination of claim 6 wherein generally radial vanes are provided to cause fluid to rotate at the same velocity as the rotor.

8. The combination of claim 1 where all fluid flow is in radial directions with substantially no axial forces on the rotor.

9. The combination of claim 1 wherein said stationary nozzles define a first ring, and said rotating nozzles define a second ring, said rings having a common axis, the stationary nozzles discharging in generally clockwise relation to said axis, and the rotating nozzles discharging in a generally counterclockwise relation to said axis.

10. The combination of claim 9 wherein the first ring is located-between said axis and the second ring.

11. The combination of claim 9 including primary structure defining entrances to said first nozzles, said entrances tapering generally radially outwardly, relative to said axis.

12. The combination of claim 11 including structure defining entrances to said second nozzles, said entrances to the second nozzles tapering generally radially outwardly, relative to said axis.

13. The combination of claim 1 including an annular surface extending about said axis, between said rings and positioned to receive impact of fluid discharging from said stationary nozzles.

14. The combination of claim 13 including a passage or passages via which fluid discharging from said stationary nozzles and impacting said annular surface can by-pass said surface to flow to the rotating nozzles.

15. The combination that includes a series successive of turbines as defined in claim 1, the rotors of which are operatively connected to said shaft, said turbines positioned to successively pass said fluid, via the turbine stationary and rotating nozzles.

16. The combination that includes a series succession of turbines each turbine including a rotor on a shaft and having, a) stationary nozzles discharging fluid, thereby producing impulse forces on said rotor, b) internal passages in the rotor producing compression of the fluid, c) rotating nozzles on the rotor discharging fluid to a pressure lower than the discharge pressure of the stationary nozzles, thereby producing reaction forces on the rotor, d) whereby shaft power is produced, e) the rotor of the turbines being operatively connected to said shaft, said turbines positioned to successively pass said fluid, via the turbine stationary and rotating nozzles, f) and wherein each turbine includes a seal or seals located to enable the discharge pressure from the rotating nozzles to be lower than the discharge pressure from the stationary nozzles.

17. The combination of claim 15 wherein successive turbines define, with associated casing structure, sealed fluid passing compartments.

18. A fluid driven turbine comprising, in combination:

a) first rotating fluid driven vanes defining an impulse turbine stage, b) second rotating fluid driven vanes defining a reaction turbine stage, and having fluid inlet and outlet sides, c) and a fluid compression zone in the fluid path between said first and second vanes, and defining a fluid compression stage, d) the turbine having structure sealing off between said inlet and outlet sides.

19. The combination of claim 18 wherein said first vanes extend in a first ring, said second vanes extend in a second ring, said rings being coaxial, and said fluid compression zone being annular and located in the fluid path between said rings.

20. The combination of claim 18 including a rotating surface toward which said fluid in said path travels and produces fluid compression.

21. The combination of claim 19 including a rotating surface toward which said fluid in said path travels and produces fluid compression, and wherein said rotating surface extends annularly and is coaxial with said vane rings.

22. The combination of claim 19 wherein said first ring of vanes is stationary, and said second ring of vanes is rotary, there being structure carrying said second ring of vanes for rotation.

23. A fluid driven turbine comprising, in combination:

a) first rotating fluid driven vanes defining an impulse turbine stage, b) second rotating fluid driven vanes defining a reaction turbine stage, c) and a fluid compression zone in the fluid path between said first and second vanes, and defining a fluid compression stage d) and wherein said second vanes have a fluid inlet side, and a fluid outlet side, and including a seal sealing off between said inlet and outlet sides.

24. The combination of claim 1 wherein a continuous cylindrical surface is provided to receive the flow from the stationary nozzles.

25. A turbine including a rotor on a shaft and comprising in combination stationary nozzles discharging fluid, thereby producing impulse forces on a rotor; internal passages in the rotor producing compression of the fluid; nozzles spaced apart on the rotor and discharging fluid to a pressure maintained lower than and isolating from the discharge pressure of the stationary nozzles, structure for isolating and maintaining said pressure of fluid discharging from said rotor nozzles being lower than pressure of said fluid of said stationary nozzles thereby producing reaction forces on the rotor whereby shaft power is produced.

26. The combination of claim 25 wherein radial vanes are provided to cause fluid to rotate at the same velocity as the rotating rotor.

27. The combination of claim 25 wherein all flow is in the radial direction with no axial forces on the rotor.

28. The combination of claim 25 wherein several rotors as defined in claim 25 are attached to the same shaft to achieve a multistage expansion turbine.

* * * * *

UNITED STATES PATENT AND TRADEMARK OFFICE

CERTIFICATE OF CORRECTION

PATENT NO. : 6,354,800 B1
DATED : March 12, 2002
INVENTOR(S) : Lance G. Hays

It is certified that error appears in the above-identified patent and that said Letters Patent is hereby corrected as shown below:

Column 6,
Line 24, "the turbine having structure isolating said second pres-" should read -- the turbine having a configuration such that said second pres- --.

Signed and Sealed this

Twenty-first Day of March, 2006

JON W. DUDAS
*Director of the United States Patent and Trademark Office*